United States Patent [19]

Kime

[11] 4,252,087

[45] Feb. 24, 1981

[54] RAPID RESPONSE STEAM GENERATING APPARATUS AND METHOD

[76] Inventor: Wellesley R. Kime, 8745 Appian Way, Los Angeles, Calif. 90046

[21] Appl. No.: 32,935

[22] Filed: Apr. 24, 1979

[51] Int. Cl.[3] ..... F22B 7/00

[52] U.S. Cl. ..... 122/158; 122/39; 122/367 R; 122/476

[58] Field of Search ..... 122/459, 460, 461, 466, 122/467, 469, 476, 477, 479 R, 479 A, 482, 483, 487, 449, 116, 127, 135 F, 158, 367 C, 408 R, 39, 40

[56] References Cited

U.S. PATENT DOCUMENTS

| | | | |
|---|---|---|---|
| 1,090,779 | 3/1914 | Dailey | 122/158 |
| 1,706,360 | 3/1929 | Newhouse | 122/479 A |
| 1,948,537 | 2/1934 | Noack | 122/476 |
| 2,589,218 | 3/1952 | Bishop | 122/476 |
| 3,076,445 | 2/1963 | Ohlhaver | 122/459 |
| 3,734,066 | 5/1973 | Scheyen | 122/367 R |

*Primary Examiner*—Henry C. Yuen

[57] ABSTRACT

Provided is a steam generating system effective to rapidly and momentarily respond to a drop in steam pressure when utilized in connection with a steam-operated device. Super-heated steam is passed from a heating unit to a vaporization chamber in which a liquid-saturated cartridge is positioned and through which super-heated steam is passed. In addition, a heat storage and liquid supply means are provided above the cartridge whereby, upon a drop in pressure in the generating system, steam is rapidly raised to a desired, predetermined pressure. Steam in the system is recycled through a superheating chamber and is conveyed back into the vaporization chamber, this for a duration in which the steam pressure is below the set predetermined level. Control means are provided to regulate ratio of fuel, typically powdered fuel, and air, typically oxygen or oxygen-rich air. Also controlled is the rate of vaporization and the recirculation of steam in the heating unit.

49 Claims, 6 Drawing Figures

RAPID RESPONSE STEAM GENERATING APPARATUS AND METHOD

BACKGROUND OF INVENTION

Inasmuch as the global supply of liquid fossel fuels is diminishing, it has become increasingly imperative to provide alternate and, thus far, unconventional combustion means for combustible substances or materials other than, e.g., gasoline or petrol, oil, and the like. In this regard, it is possible to utilize substitute fuels derived from materials which can be found, in abundance, throughout the world as for example, wood, coal, dried vegetation, or products thereof. Also utilized may be materials obtained from sewage disposal plants. In short, the materials and substances from which a workable and combustible material for fuel may be obtained are plentiful and practically inexhaustible.

For reasons stated above, it would be advantageous to provide a system for the supply and combustion of any type of fuels in either liquid, gaseous or pulvarized form to effect a rapid and momentary response in the production of steam pressure.

SUMMARY OF THE INVENTION

Accordingly, object of the invention is to provide a novel powdered fuel injected combustion and steam-generating system adapted for use with a steam-operated device and in which any type of fuel or mixtures thereof, in either gaseous, liquid or powdered form is ignited to produce energy for such devices.

A further object of the invention is to provide a system of the character described in which the powdered fuel employed for ignition to produce steam is derived from a combustible material as, for instance, wood, coal, sewage products, products of vegetation, and the like, and said fuel being in powder or pulvarized form.

A still further object of the invention is to provide a system of the type described which is adapted to utilize the powdered combustible material in combination with a gaseous substance, typically air, oxygen or oxygen rich air.

Yet a further object of the invention is to provide a system as presently described which rapidly replenishes a drop in steam pressure experienced in the system.

Yet a still further object of the invention is to provide a rapid response steam generator which is easy as regards to its operation, economical to manufacture, and simple in construction.

According to the invention, the system provides the combination of a super-heating chamber in which steam is super-heated by the combustion of fuel and the transfer of heat energy from products of combustion through a heat exchanger to steam; a vaporization chamber for vaporizing liquid by the transfer of heat from super-heated steam to a liquid with an artifically expanded surface area; means to artifically expand the surface area of liquid to be vaporized in the vaporization chamber; means to provide a flow of steam from the vaporization chamber to a super-heating chamber; means to provide a flow of steam from the super-heating chamber to the vaporization chamber; and means to control the flow of super-heated steam from the super-heating chamber to the vaporization chamber.

According to the invention the transfer of super-heated steam from the super-heating chamber to the vaporization chamber occurs when the pressure in the vaporization chamber is below a predetermined level, whereupon steam replenishing means are actuated to automatically and almost instantaneously commence and/or terminate the generation of additional steam to return and maintain the steam in the steam generator to and at a predetermined pressure.

The surface area of liquid used in the vaporization chamber is "artifically" expanded by forming fine droplets and/or saturating a material or substance with the liquid. When usable steam pressure is released from the vaporization chamber and pressure in the chamber is reduced below a predetermined level, the following results occur: (1) super-heated steam from the super-heating chamber is drawn into the vaporization chamber. Heat energy from the super-heated steam is transferred to the liquid with the artifically expanded surface area, following which rapid reneration of steam occurs; (2) steam from the vaporization chamber is forced through the super-heating chamber where it is super-heated and is then returned to the vaporization chamber; and (3) liquid stored in the vaporization chamber is sprayed into said chamber causing fine droplets to be formed. If a material or substance is used in the vaporization chamber to expand the surface area of the liquid, the material or substance is recharged with liquid by the spray. The above process repeats itself as long as the steam pressure in the vaporization chamber is below a predetermined amount.

When the temperature of the heat exchanger in the super-heating chamber falls below a predetermined level, combustion of fuel is commenced and continues to bring the temperature of the heat exchanger back to the set predetermined level. The products of combustion are discharged through the heat exchanger in the super-heating chamber to a heat trap where hotter gasses rise and surround the vaporization chamber and cooler products of combustion drop and are discharged through an exhaust passage.

Pressure generated in the steam generator may be used to force liquid obtained by condensing steam outside the steam generator back into the steam generator where it will find its way into the liquid reservoir, or it may be sprayed directly into a storage of super-heated steam for an instantaneous generation of steam; to spray liquid in the vaporization chamber and/or resaturate a material or substance with the liquid, thereby artificially expanding the surface area of the liquid; to terminate the flow of super-heated steam from the super-heating chamber into the vaporization chamber; to force steam from the vaporization chamber through the super-heating chamber and back into the vaporization chamber; and to activate a steam operated device, e.g., a molecular air separator, for the production of oxygen or oxygen-rich air for use in the combustion of the fuel used to heat the heat exchanger in the super-heating chamber.

Further objects, features and advantages will become apparent to those skilled in the art from the following description when taken in connection with the attached drawings, in which:

DESCRIPTION OF THE PREFERRED EMBODIMENTS

Figure 1:
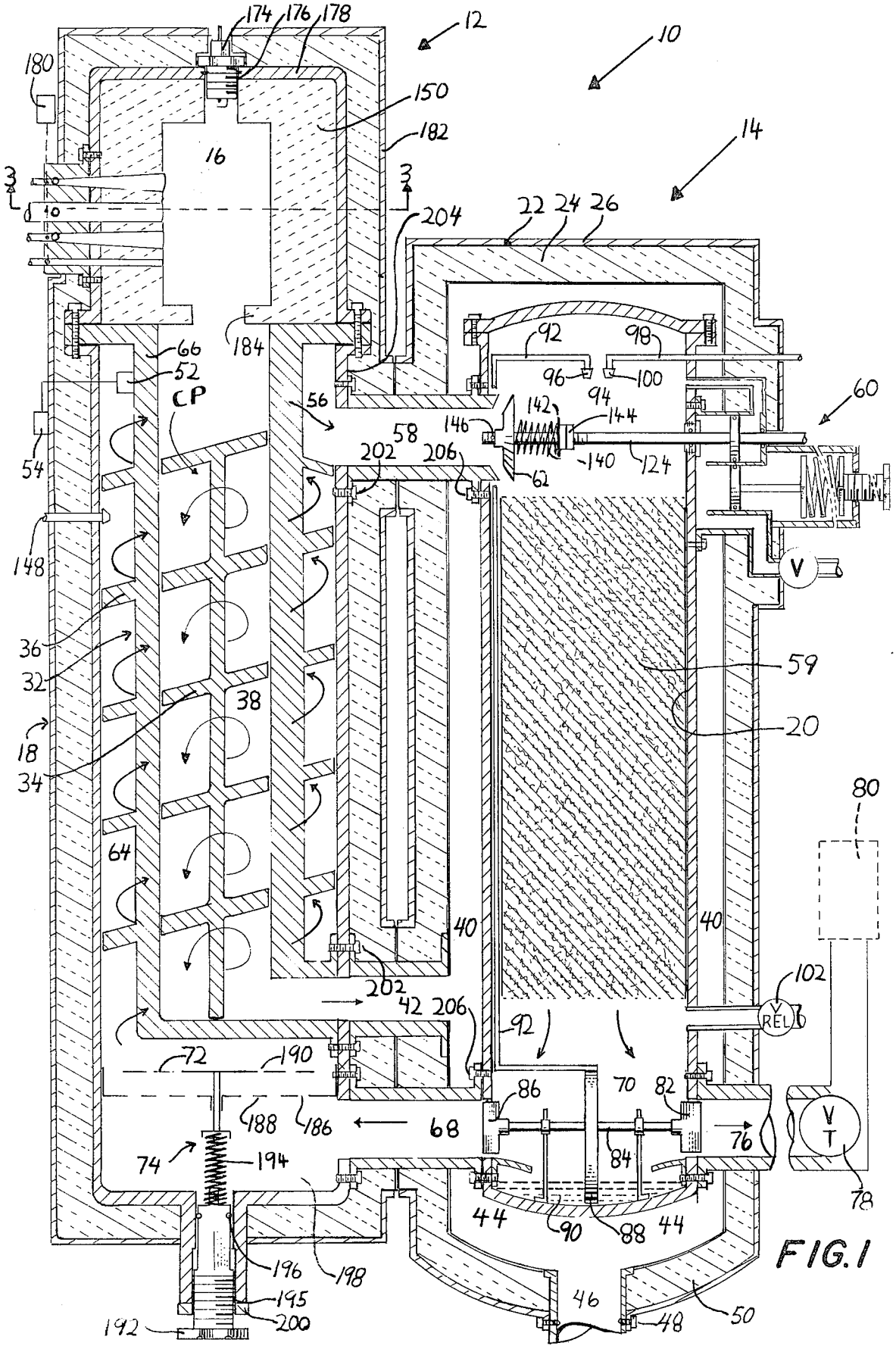
FIG. 1 is a plan view, in cross-section of a rapid-response steam generator embodying the present invention.

Referring now to the drawings in which like referenced numerals index like parts, and with attention initially directed to FIG. 1, there is shown a steam generator, referenced generally by the numeral 10. The generator shown and discussed herein can be utilized with any type of fuel or combustible material, either liquid, gaseous or powdered state, in combination or separately. The device 10, in the arrangement according to the invention, incorporates a heating unit 12 and a vaporization unit 14. Heating unit 12 includes a combustion chamber 16 and a pressuized heat exchanger 18. Vaporization unit 14 is formed with a pressurized vaporization chamber 20.

Sheath 22 comprised of a layer of heat and cold resistant material 24 adhered to protective and supportive metalic cover 26 is superimposed on the exterior of device 10. Sheath 22 is separable from the device exterior in two equal halves which, normally, are interconnected peripherally by a multiplicity of screws similar to screw 28 FIG. 3, along separation lines 30.

Heat exchanger 18, FIG. 1, incorporates core assembly 32 which includes spiral inner (exhaust) core 34 and spiral outer (vapor) core 36. Vapor in heat exchanger 18 is super-heated. By "super-heated" vapor is meant vapor heated in excess of the boiling point (of the liquid from which it is derived) at the target operating pressure in vaporization chamber 20.

A mixture of fuel and air, typically oxygen or oxygen-rich air, is injected into combustion chamber 16 through passage means described hereinafter, for ignition in the chamber. Combustion products, indicated by the arrows CP, circulate around spiral inner core 34 via passages 38 defined by the sprials of core 34. Combustion products, having a downward flow direction, exit from heat exchanger 18 into a heat recirculation annular channel 40, via a passage 42, the former communicating at its lower end with a heat trap 44. Heat rises upwardly from trap 44 and surrounds vaporization chamber 20 by virtue of annular channel 40. Cooler products of combustion move downwardly into trap 44 and are discharged from device 10 through exhaust 46 secured by screws 48 to the lowermost portion 50 of sheath 22 of vaporization unit 14.

Heat sensing means 52 are provided to actuate and de-actuate a switch element 54 to control the flow of fuel and gaseous substance when core assembly 32 is heated to a predetermined temperature. Vapor in contact with exchanger 18 is heated and rises.

Super-heated steam passes from the upper region 56 of heat exchanger 18 through an upper pass 58 into vaporization chamber 20. Steam from passage 58 is conducted to flow downwardly through a removable and exchangable cartridge 59 typically filled with fiber (e.g. fiberglas or stainless steel). Said cartridge is disposed axially within vaporization chamber 20, the latter being substantially hollow and enlongated in geometry. Cartridge 59 is saturated with liquid, and hot steam passing through the liquid saturated cartridge vaporizes the liquid. As pressure resulting from this vaporization within chamber 20 increases to a predetermined or set level, herein known as the pressure target level, vaporization pressure control means referenced generally by the numeral 60 and described hereinafter, activate a valve member 62 which closes passage 58.

Upon closing of passage 58 by valve 62 the gas flow through passage 64 defined by the spirals of outer core 36 is prevented from entering vaporization chamber 20 and the resulting temperature increase or build-up in junctional area 66 of core assembly 32 is sensed by heat sensing means 52. When the temperature at said location reaches a predetermined (adjustable) point said heat sensing means deactivates switch element 54 and which, in turn, terminates the fuel/air flow into combustion chamber 16. It can be appreciated that heat sensing means 52 may be placed anywhere in heat exchanger 18 and the compensatory temperature control adjustments made. For that matter, a heat sensing means (not shown) may be located in passage 42 for detecting the heat of "spent" exhaust gasses. For greatest fuel efficiency the maximum temperature of "spent" exhaust gasses exiting through passage 42 will be at or close to the boiling point of liquid at the target pressure. The length of core assembly 30 ideally provides for a broad temperature differential.

Additionally, upon closing of passage 58 by valve 62 the rise in temperature and resulting expansion of gasses in passage 64 tend to cause escape downward of said gasses through passage 68 into the lower portion 70 of vaporization chamber 20. This downward flow of vapor may be regarded as back-flow and this flow activates valve 72 controlled by flow control means 74 into its closed position thereby preventing further flow of vapor in this direction.

Vapor pressure is allowed to escape from vaporization chamber 20 through pressure discharge passage 76 in the lower section 70 of chamber 20. Associated with discharged passage 76 is a throttle valve 78 which, when opened, allows steam to escape from chamber 20, to activate a steam-utilizing mechanism as, for instance, the pistons of a steam engine indexed generally by dashed lines 80.

Upon release of steam from discharge 76, the pressure within vaporization chamber 20 drops causing valve 62 to open, thereby to reestablish vaporization in vaporization chamber 20 upon inter-engagement with superheated steam and liquid contained in cartridge 59.

A fan blade 82 associated with discharge 76 is rotated by steam exiting therefrom. Blade 82 rotates a shaft 84 which in turn rotates a second blade 86 at the end of passage 68 and blowing steam therethrough into passage 64 of outer core 36 of heat exchanger 18. Further, during rotation of shaft 84 a rotary pump 88 is energized which causes liquid from a liquid reservoir 90 to be pumped through a tube 92 and into the upper region 94 of vaporization chamber 20 via spray head 96. A second tube 98 having a spray head 100 is connected to means, not shown, for forcing liquid (recondensed steam) back into vaporization chamber 20. In this manner, vaporization cartridge 59 is refilled with liquid.

A pressure relief valve 102 is provided in the vaporization chamber 20 in a position above discharge passage 76.

Figure 4:
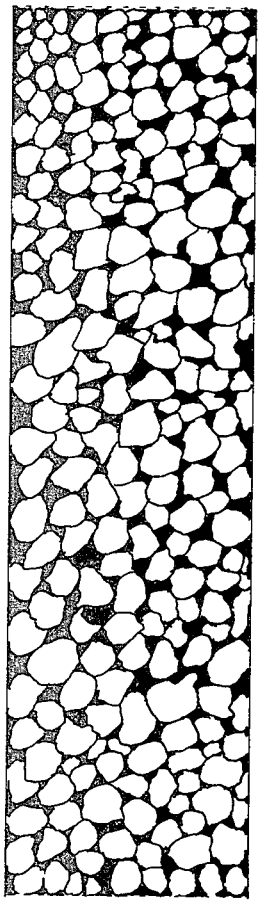
FIG. 4 illustrates an alternate embodiment of the liquid cartridge incorporated in the vaporization chamber of the generator of FIG. 1.

In the embodiment shown, cartridge 59 is contained with fiber to increase the vaporization area to, thereby, increase the rate of vaporization. It will be appreciated that instead of fiber different media to be saturated with liquid may be utilized as, for instance, particulate matter, FIG. 4, or felt or other suitable material.

Passage 58 between heat exchanger 18 and vaporization chamber 20 may be substantially large in cross-section to serve as a holding area for super-heated steam, and liquids can be sprayed into the passage confines for the instant production of steam, e.g., via a tube (not shown) coupled to a piston pump (not shown).

Figure 5:
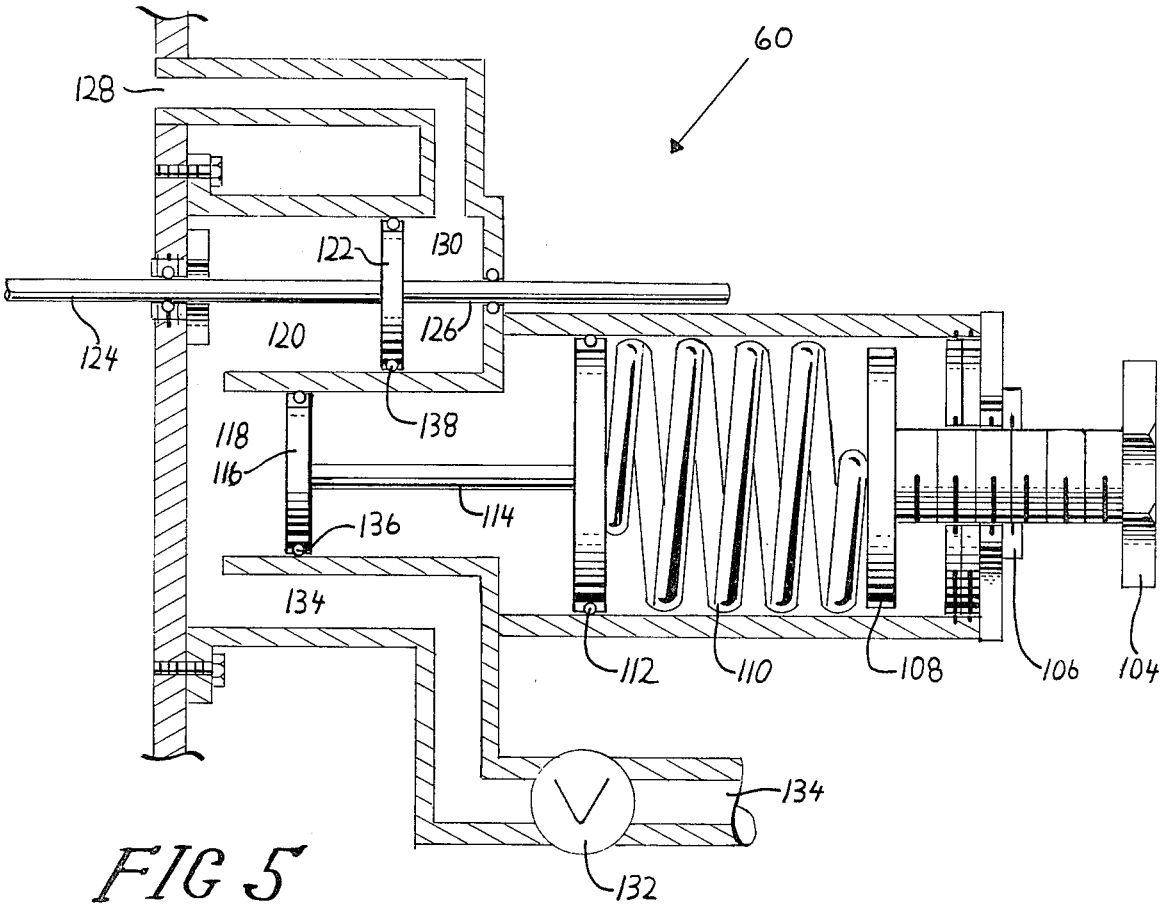
FIG. 5 is a detailed cross-sectional view of the vaporization control means incorporated in the steam generator of FIG. 1.

Vaporization control means 60 which actuate valve 62 into an open or closed position, are comprised of an adjustable bolt 104, FIG. 5, which is held in place by a lock nut 106 and has an end piece 108, the latter applying pressure on a tension spring 110. Spring 110 forces a second end piece 112 outwardly from end piece 108 and the force applied is transmitted through a shaft 114 onto a piston 116. Piston 116, in turn, applies pressure on a fluid 118, typically hydraulic oil, which is forced into a communicating chamber 120, urging a piston 122 backward and pulling a shaft 124 at the outer end 126 at which valve 62 is attached, along with it. A visual measurement of the process can be made by observing the projecting length of a measuring shaft 126. As pressure builds up in the system, force is applied through passage 128 onto cylinder 130 and piston 122 is forced forward causing valve 62 to close passage 58 when the target pressure is reached. A valve 132 controls a passage 134 for hydraulic fluid which may be added or removed. In addition to valve 132, a pressure gauge, not shown, may be associated with tube 134 to show the pressure of hydraulic fluid.

Piston 116 and 122 are provided with "O-rings" 136 and 138 respectively.

Spring pressure is applied on valve 62, FIG. 1, by a spring member 140 held in position by a disc 142 on shaft 124. The disc, in turn, is kept on shaft 124 by lock nuts 144. Valve 62, at its forward or outer end, is retained in position by a cotter pin 146. The tension of spring 140 may be adjusted or varied by lock nut 144.

By virtue of this arrangement, flow of pressurized vapor from heat exchanger 18 is enabled to pass into the vaporization chamber when the pressure exerted on valve 62 by vapor from heat exchanger 18 exceeds the force applied on valve 62 by vapor in chamber 20 plus the tension of spring 140.

An auxiliary supply inlet 148, for liquids is provided in the heat exchanger and communicates with outer core 36 to provide momentary desired increase of pressure within generator 10.

Figure 3:
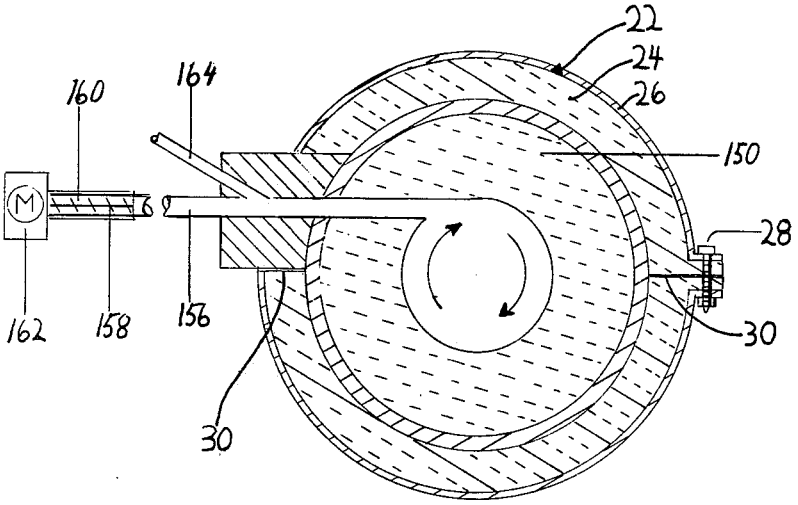
FIG. 3 is a cross-sectional view taken on line 3—3 of FIG. 1.

Combustion chamber 16, typically, is lined with a fire and oxidation resistant material 150, preferably ceramic or fire-brick material, and which prevents heat from escaping outwardly. As shown in FIG. 3, flame, typically, is set in a spiral motion to insure complete combustion of fuels, particularly powdered solid fuels supplied by a solid fuel pulverizer, not shown. This is accomplished by injecting fuel and air, typically oxygen and oxygen-rich air, in an eccentric location such that the flame follows a circular and spiral path and sustains itself by consuming the unburned fuel.

Figure 6:
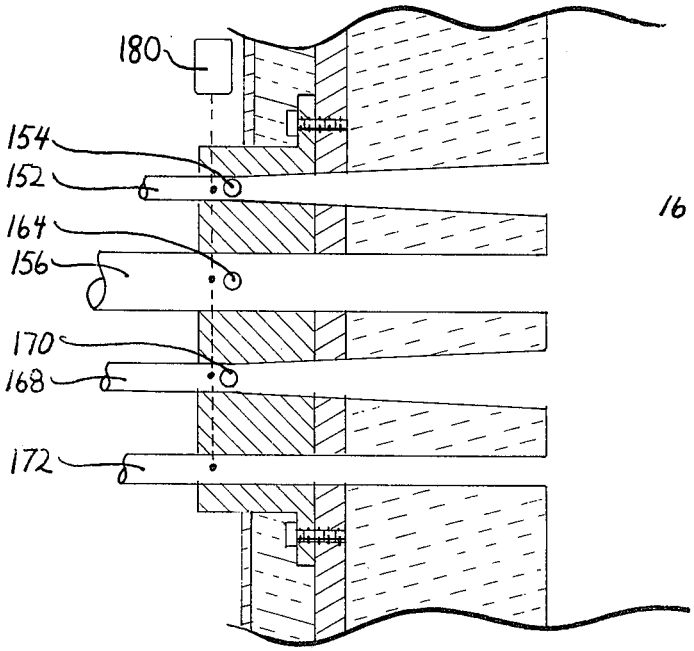
FIG. 6 is a detailed cross-sectional view of the fuel and gaseous supply system in the combustion chamber of FIG. 1.

Liquid fuel, for example gasoline, oil, kerosene, and alcohol, is admitted through combustion chamber 16 through a fuel feed supply passage 152, FIG. 6, and is combined with oxygen or oxygen-rich air via opening 154 in passage 152. Powdered fuel e.g., from processed coal, wood, sewage products and the like, is injected into chamber 16 via powdered fuel passage 156, the latter provided with an associated spiral worm screw 158, FIG. 3, for the propulsion of the powdered fuel which enters passage 156 through opening 160. A motor 162 powers the screw 158. Said motor is variable and controllable speed. Oxygen or oxygen-rich air is mixed with the powdered fuel via an inlet 164, FIG. 6, in passage 156. Gaseous fuel e.g., hydrogen, propane, methane etc., is injected into chamber 16, FIG. 6, via a gaseous fuel passage 168. Oxygen or oxygen-rich air is mixed with the gaseous fuel by way of an inlet 170 provided in passage 168. Oxygen or oxygen-rich air is mixed with the gaseous fuel by way of an inlet 170 provided in passage 168. Additional air or oxygen to provide an after-burning effect in the system is added through a supplementary oxygen or air passage 172. The thus admitted or injected mixture is ignited by an ignition device 174, FIG. 1, which, herein is in the form of a spark plug threadably received in aperture 176 in the upper wall 178 of combustion chamber 16. Control means 180, FIG. 6, are provided to regulate the fuel/air ratio. An excess of oxygen is typically provided via said passage 172 to insure complete combustion of fuels.

Spark plug 174 is recessed to avoid direct contact thereof with the flame during spiralling of the latter, thereby to avoid melting of the electrodes and other metal parts of the plug. A fuel ignitor may be substituted for said spark plug or other suitable ignition means may be used.

The outer housing 182 of combustion chamber 16 is connected to heat exchanger 18.

Combustion chamber 16 may further be provided with an optional, inwardly directed annular ring 184 to retain unburned fuel by centrifugal force while allowing products of combustion to escape more easily since these products are lighter and pass more readily to the center of chamber 20 and then downwards.

Flow control means 74 to actuate one way valve 72 is an adjustable spring loaded mechanism for prohibiting a flow of super-heated vapor from heat exchanger 18 to the lower part 70 of vaporization chamber 20. Gasses pass easily through openings 186 in the lower valve plate 188 and, thence, flow through openings 190 in a disc shaped valve 72. The holes 190 in valve 72 are off-set with respect to holes 186 in lower valve plate 188. The amount of force holding valve plate 72 in open upward position can be adjusted by a turning bolt 192 which loosens or tightens the tension on a spring 194 associated with valve 72. Alternately, valve 72 may be of a solid round structure with the gasses flowing around the valve periphery, not shown. Bolt 192 is shown with threads 195 and an "O ring" 196 to prevent the escape of vapors from area 198. Vapor attempting to pass downward from passage 64 to the lower portion 198 of heat exchanger 18, moves valve 72 to a downward or closed position, prohibiting further flow in this direction. Lock nut 200 secures bolt 192 in position.

Following removal of sheath 22, heating unit 12 is detachable from vaporization unit 14 via screw member 202 along a separation line 204. Also, vaporization unit 14 may be disconnected from heating unit 12 by dislodgment of sheath 22 from the outer surface of device 10 and upon subsequent disengagement of screw members 206.

Figure 2:
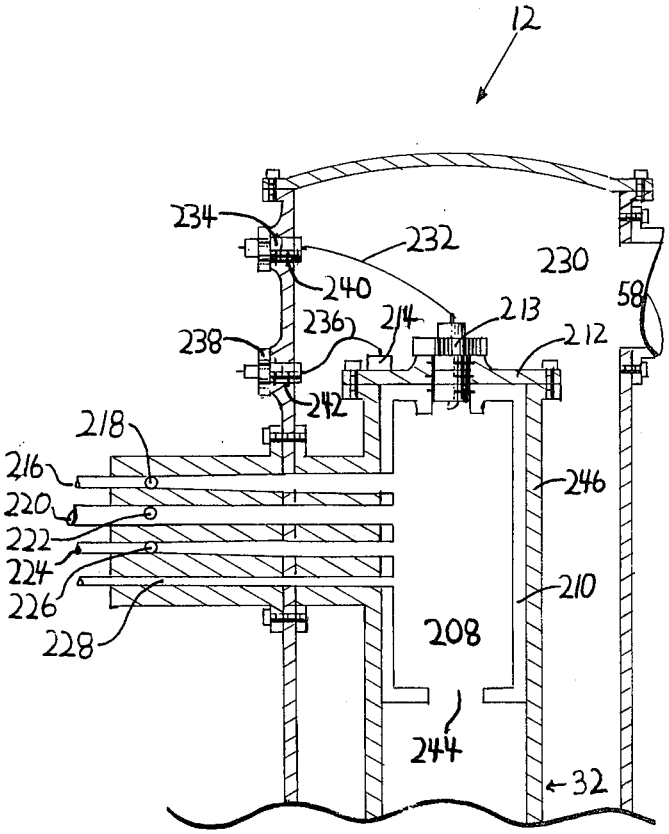
FIG. 2 is a view of the steam generator of FIG. 1, however embodied with the combustion chamber positioned within the generator.

FIG. 2, shows an alternate embodiment of the combustion chamber arrangement according to the invention (with sheath 22 removed for simplicity of illustration.) In the arrangement shown, combustion chamber or area 208 is positioned within the confines of heating unit 12, this opposed to the arrangement of FIG. 1, in which combustion chamber 16 is disposed on the outside and forms part of the device outer structure.

Combustion chamber 208 is formed with an inner layer or lining 210 of oxidation and heat-resistant material of any suitable composition, e.g., ceramic. Provided in the top wall 212 of chamber 208 is an ignition 213 which in this arrangement is an electrically or electronically operated device. Also, positioned in upper wall 212 is a heat sensing device 214 coupled to a switch or switches, not shown, to control the flow of fuel and air (oxygen or oxygen-rich air), via inlets 216 through 228, these inlets corresponding to the fuel and gaseous substance inlets 152, 154, 156, 164, 168, 170 and 172 of the arrangement of FIG. 1, and having the same function and being of the same configuration. In all other respects combustion chamber 208 is similar to its counterpart of FIG. 1, with the exceptions, however, that passage 58, FIG. 2, extends from the upper region 230 of heating unit 12, substantially in the plane of upper wall 212; that the electrical conducting wire 232 from the ignition means 213 is connected to electrically insulated connector 234 and the electrical conducting wire 236 from temperature sensing means 214 is connected to electrically insulated connector 238, both said connectors are threadably received in the wall of said superheating chamber at 240 and 242 respectively; and products of combustion pass through the lower combustion chamber outlet 244 into core assembly 32 of heat exchanger 18 which in this event is integral with outer wall 246 of combustion chamber 208. Upper region 230 constitutes part of a void between the exterior of combustion chamber 208 and the interior walls of heating unit 12.

Means other than those described may be used for admitting or injecting fuel and air/oxygen or oxygen rich air. Various additional modifications and extensions of this invention will become apparent to those skilled in the art. All such variations and deviations which basically rely on the teachings through which this invention has advanced the art are properly considered to be within the spirit and scope of the invention.

What is claimed is:

1. A rapid response steam generator, comprising:

a first chamber for super-heating steam;

a second chamber for vaporizing liquid by the superheated steam from the super-heating chamber;

means to artificially expand the surface area of said liquid to be vaporized in said vaporization chamber;

a combustion chamber for the combustion of fuel for generating heat for heating the super-heating chamber, the combustion chamber having inlet means for the supply of fuel and gaseous substance;

first passage means to provide a flow of steam from said super-heating chamber to the vaporization chamber;

second passage means to provide a flow of steam from said vaporization chamber to said super-heating chamber;

first control means to regulate the rate of vaporization in said vaporization chamber;

second control means to regulate the supply of fuel and gaseous substance to said super-heating chamber;

liquid-storage means;

liquid injection means for the supply of liquid from said liquid-storage means to said vaporization chamber prior to vaporization of said liquid; and steam discharge means accociated with said vaporization chamber.

2. The generator of claim 1, further comprising means for the storage of super-heated steam in said generator.

3. The generator of claim 1, further comprising a heat trap in said generator.

4. The generator of claim 3, wherein said heat trap is disposed in said vaporization chamber at the bottom region thereof.

5. The generator of claim 1, further comprising: a heat exchanger in communication with the combustion chamber for heating the super-heating chamber.

6. The generator of claim 5, further comprising ignition means for said fuel and gaseous substance in said combustion chamber.

7. The generator of claim 6, wherein said combustion chamber is formed with an upper wall and said ignition means is formed in said upper wall.

8. The generator of claim 7, wherein said ignition means is a spark plug.

9. The generator of claim 7, wherein said combustion chamber has an interior lined with a fire and oxidation resistant material.

10. The generator of claim 9, wherein said material is a firebrick lining.

11. The generator of claim 9, wherein said combustion chamber further comprises an inwardly directed projection to retain unburnt fuel but allowing the passage of products of combustion.

12. The generator of claim 9, wherein said material is a ceramic lining.

13. The generator of claim 5, wherein said heat exchanger comprises an inner core and an outer core, said inner core communicating said combustion chamber with a heat trap.

14. The generator of claim 13, wherein said heat trap communicates with the exterior of said vaporization chamber.

15. The generator of claim 13, wherein said inner core communicates with said heat trap via a passage.

16. The generator of claim 13, wherein: a passage is defined by the inner core wherein products of combustion spiral downwardly, and a passage is defined by the outer core wherein heated vapors spiral upwardly.

17. The generator of claim 13, wherein said inner core communicates with said heat trap via a passage.

18. The generator of claim 14, wherein said heat trap communicates with said exterior by way of an annular passage.

19. The generator of claim 1, wherein said first passage means is opened and closed by said first control means.

20. The generator of claim 19, wherein said first control means is a piston-actuated valve member.

21. The generator of claim 1, wherein the means to artificially expand the liquid surface area is a cartridge saturated with liquid.

22. The generator of claim 21 wherein said cartridge is filled with a particulate matter.

23. The generator of claim 21, wherein said cartridge is filled with fiberglas.

24. The generator of claim 21, wherein said cartridge is filled with fiber.

25. The generator of claim 1, wherein said liquid storage means are disposed at the bottom of said vaporization chamber.

26. The generator of claim 1, wherein said liquid injection means include a tubular member communicating said vaporization chamber with said liquid storage reservoir.

27. The generator of claim 26, wherein said liquid injection means further comprises a spray head for spraying the liquid into said vaporization chamber.

28. The generator of claim 1, wherein said liquid injection means comprises means for the supply of recondensed liquid to said vaporization chamber.

29. The generator of claim 28, further comprising a spray head for said injection means for said recondensed liquid.

30. The generator of claim 1, further comprising a layer of heat and cold resistant material super-imposed on the exterior of said generator.

31. The generator of claim 30, wherein said heat and cold resistant material is adhered to a surrounding protective cover.

32. The generator of claim 1, wherein said steam discharge means are formed at the bottom of said vaporization chamber.

33. The generator of claim 32, wherein a throttle valve is associated with said steam discharge means.

34. The generator of claim 1, wherein said vaporizing chamber is elongated in configuration.

35. The generator of claim 1, wherein said liquid injection means comprises a pump.

36. The generator of claim 35, wherein said pump is energized by the flow of vapor from said steam discharge means.

37. The generator of claim 1, further comprising means to propel the flow of steam from said vaporization chamber to said super-heating chamber.

38. The generator of claim 37, wherein said means to propel the flow of steam from said vaporization chamber to said super-heating chamber is by way of a fan, said fan being energized by the flow of vapor from said steam discharge means.

39. The generator of claim 1, further comprising pressure relief means in said vaporization chamber.

40. The generator of claim 1, wherein the vaporization control means comprises valve means for opening and closing said first passage means, and adjustable piston means for automatically actuating said valve means at a predetermined pressure level within said vaporization chamber.

41. The generator of claim 40, wherein said adjustable piston means is hydraulically energized.

42. The generator of claim 1, further comprising heat sensing means associated with said super-heating chamber and switch means coupled to said sensing means for actuating and de-actuating the fuel and gas supply control means.

43. The generator of claim 1, further comprising third control means to prevent back-flow of vapors from said super-heating chamber to said vaporization chamber.

44. The generator of claim 1, further comprising auxiliary liquid supply means associated with said super-heating chamber to provide momentary desired increase of pressure within said generator.

45. The generator of claim 1, wherein said super-heating chamber is enlongated in configuration.

46. The generator of claim 1, wherein the combustion chamber is positioned outside the confines of the super-heating chamber for steam.

47. The generator of claim 1, wherein the combustion chamber is positioned within the confines of the super-heating chamber for steam, wherein steam circulates around the combustion chamber.

48. A rapid response steam generating method comprising the steps of:

(a) superheating steam in a first chamber;

(b) moving superheated steam from the first chamber to a second chamber;

(c) vaporizing liquid in the second chamber with heat energy in the superheated steam moved from the first chamber to the second chamber;

(d) controlling the rate of vaporization of steam in the second chamber for tending to maintain the steam pressure in the chambers at a predetermined pressure;

(e) discharging steam under pressure from the apparatus; wherein the step of vaporizing liquid in the second chamber comprises the step of:

saturating a substance in the second chamber with liquid to be vaporized and passing the superheated steam through the substance; and wherein the step of controlling the rate of vaporization of steam in the second chamber comprises the step of:

controlling the rate of flow of superheated steam from the first chamber to the second chamber utilizing pressure responsive control means.

49. The rapid response steam pressure generating method as defined in claim 48, further comprising the step of:

(f) moving some of the steam vaporized in the second chamber to the first chamber as a source of steam to be superheated in the first chamber.

* * * * *